United States Patent [19]

Kehrli

[11] Patent Number: 4,742,646

[45] Date of Patent: May 10, 1988

[54] PANEL AND FRAME WEATHERSEAL COMBINATION

[75] Inventor: David W. Kehrli, Rochester, N.Y.

[73] Assignee: Schlegel Corporation, Rochester, N.Y.

[21] Appl. No.: 12,350

[22] Filed: Feb. 9, 1987

[51] Int. Cl.[4] ..... E06B 7/16

[52] U.S. Cl. ..... 49/479; 49/475

[58] Field of Search ..... 49/479, 484, 485, 489, 49/495, 496, 497, 475

[56] References Cited

U.S. PATENT DOCUMENTS

| | | | |
|---|---|---|---|
| 1,883,609 | 10/1932 | Dennis | 49/495 |
| 2,739,358 | 3/1956 | Kunkel | 49/495 |
| 2,949,651 | 8/1960 | Hill | 49/495 |
| 3,171,166 | 3/1965 | Heimann | 49/495 |
| 3,177,533 | 4/1965 | Davis | 49/495 |
| 3,217,921 | 11/1965 | Frease | 49/479 |
| 3,555,734 | 1/1971 | Hirtle et al. | 49/484 |
| 3,642,164 | 2/1972 | O'Neal | 49/495 |
| 4,112,623 | 9/1978 | McPherson | 49/495 |
| 4,185,417 | 1/1980 | McKann | 49/488 |

FOREIGN PATENT DOCUMENTS

| | | | |
|---|---|---|---|
| 0203248 | 12/1954 | Australia | 49/479 |
| 967812 | 5/1975 | Canada | 49/495 |
| 0611951 | 4/1926 | France | 49/479 |

OTHER PUBLICATIONS

Schlegel Co. brochure, "Dual Durometer Extrusions".

*Primary Examiner*—Kenneth J. Dorner
*Assistant Examiner*—Gerald A. Anderson
*Attorney, Agent, or Firm*—Cumpston & Shaw

[57] ABSTRACT

A panel and frame weatherseal combination is disclosed for sealing the marginal edges of a panel closing an opening defined by a frame, with particular utility for sealing the corner areas thereof. The panel has an exterior surface facing the outdoors. The weatherseal comprises a longitudinally extending backing strip of a generally uniform cross-section throughout its length, to which a plurality of spaced-apart longitudinally extending flexible barrier fins are affixed longitudinally along and transversly extend from the backing strip. The innermost barrier fin extends past the marginal edges of the exterior surface. Any outdoor air movement or the like impinging on the exterior surface presses the innermost barrier fin into sealing engagement with the marginal edges of the exterior surface. At the corners of the panel and frame, the barrier fins are interdigitated to provide an excellent corner seal.

5 Claims, 1 Drawing Sheet

PANEL AND FRAME WEATHERSEAL COMBINATION

FIELD OF THE INVENTION

The present invention relates generally to seals, and more particularly to a panel and frame weatherseal combination for preventing the passage of air or the like through the marginal space between the panel and frame.

DESCRIPTION OF THE PRIOR ART

It is well known in the art to provide some form of seal at the margins of a panel such as a door or window for closing an opening defined by a frame, particularly with a door or window having an exterior surface which is exposed to the outdoors. A particular problem exists at the corners of the door or window, which heretofore have required special treatment, such as the application of dust plugs at the corners, to provide a good seal. Such dust plugs are expensive and inconvenient to apply.

The prior art is replete with patents on seals for sealing the margins of a door or the like, to the door frame, of which the following are exemplary:

U.S. Pat. No. 1,883,609-Dennis, Oct. 18, 1932
U.S. Pat. No. 2,739,358-Kunkel, Mar. 25, 1956
U.S. Pat. No. 2,949,651-Hill, Aug. 23, 1960
U.S. Pat. No. 3,171,166-Heimann, et al, Mar. 2, 1965
U.S. Pat. No. 3,177,533-Davis, Apr. 13, 1965
U.S. Pat. No. 3,217,921-Frehse, Nov. 16, 1965
U.S. Pat. No. 3,555,734-Hirtle, et al, Jan. 19, 1971
U.S. Pat. No. 4,112,623-McPherson, Sept. 12, 1978
U.S. Pat. No. 4,185,417-McKann, Jan. 29, 1980

A Schlegel Company brochure entitled Dual Durometer Extrusions discloses prior art sealing systems of varied design.

SUMMARY OF THE INVENTION

An object of the present invention is to provide a panel and frame weatherseal combination comprising:

a frame lying in a plane and defining an opening, the frame comprising at least one frame member having a frame face surface perpendicular to the plane;

a panel member movable in one direction to a closed position in which it closes the opening, the panel member in the closed position having an exterior surface parallel to the plane and a panel face surface perpendicular thereto, the panel face surface further being parallel to, spaced from, and facing the frame face surface; and a weatherseal interposed between the frame and panel face surfaces, the weatherseal comprising a longitudinally extending backing strip seated on the frame face surface, and a plurality of spaced-apart longitudinally extending flexible barrier fins affixed longitudinally along and transversely extending from the backing strip toward the panel face surface a predetermined distance such that at least one of the fins sealingly engages the panel face surface for sealing the space between the frame and panel face surfaces upon movement of the panel to its closed position, the innermost barrier fin being arranged to overlie a marginal edge of the exterior surface of the panel member and to sealingly engage it when the innermost fin is subjected to air movement or the like directed against the exterior surface of the panel member.

A further object of the present invention is to provide a corner seal assembly for sealing the marginal edges of a corner of a panel in a complementary corner of a frame lying in a plane and defining an opening, the frame having first and second face surfaces at right angles to one another and to the plane, comprising:

a first longitudinally extending backing strip of a generally uniform cross section throughout its length, the first backing strip having a plurality of spaced-apart longitudinally extending first flexible barrier fins affixed longitudinally along and transversely extending from the first backing strip;

a second longitudinally extending backing strip of a generally uniform cross section throughout its length, the second backing strip having a plurality of spaced-apart longitudinally extending second flexible barrier fins affixed longitudinally along and transversely extending from the second backing strip; and means for attaching the first backing strip to the first face surface with one end of the first backing strip abutting the second face surface, and attaching the second backing strip to the second face surface with one end of the second backing strip abutting the first face surface with the first and second barrier fins extending in interdigitated relation.

Still another object of the invention is to provide a method for installing a weatherseal in a corner of a frame lying in a plane and defining an opening, the frame having first and second face surfaces at right angles to one another and to the plane, comprising the steps of:

attaching to the first face surface a first longitudinally extending backing strip having a plurality of spaced-apart longitudinally extending first flexible barrier fins affixed longitudinally along and transversely extending from the first backing strip with one end of the first backing strip abutting the second face surface;

arranging on the second face surface a second longitudinally extending backing strip having a plurality of spaced-apart longitudinally extending second flexible barrier fins affixed longitudinally along and transversely extending from the second backing strip with one end of the second backing strip abutting the first face surface, and with the first and second barrier fins extending in interdigitated relation; and attaching the second backing strip to the second face surface.

BRIEF DESCRIPTION OF THE DRAWINGS

In the detailed description of the invention presented below, reference is made to the accompanying drawings, in which.

DETAILED DESCRIPTION OF THE INVENTION

Figure 1:
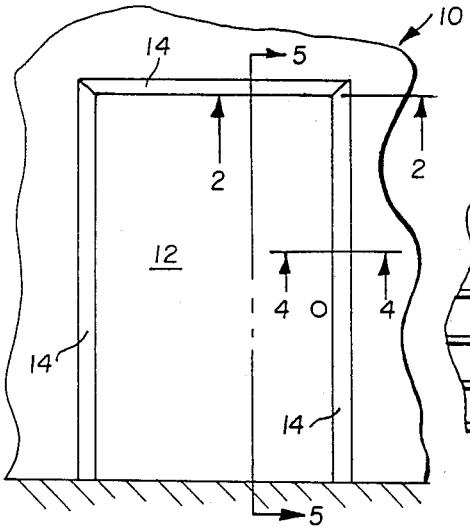
FIG. 1 is a segmental front elevation view of a door and frame weatherseal combination of this invention with the door closed.

With reference to FIG. 1, a preferred embodiment of a panel and frame weatherseal combination 10 of this invention is illustrated. Although the panel 12 is a door mounted within a door frame 14, it should be understood that this is exemplary only, since the invention is applicable to any closure involving a panel and frame, such as a window and window frame, for example. More particularly, the invention can be embodied in any sealed closure comprising a frame member defining an opening and a panel for closing the opening and sealing the marginal surfaces between the panel and frame through which rain, wind or the like may pass.

Figure 2:
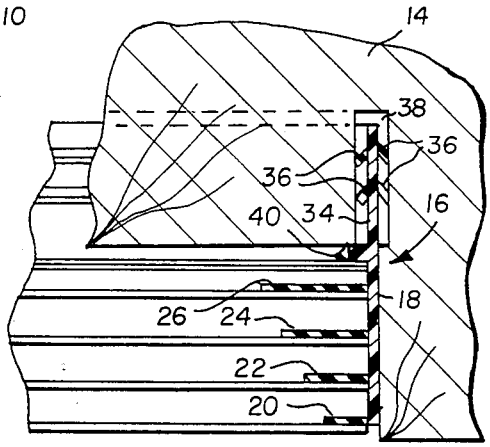
FIG. 2 is an enlarged segmental section view taken substantially along line 2—2 of FIG. 1.
Figure 4:
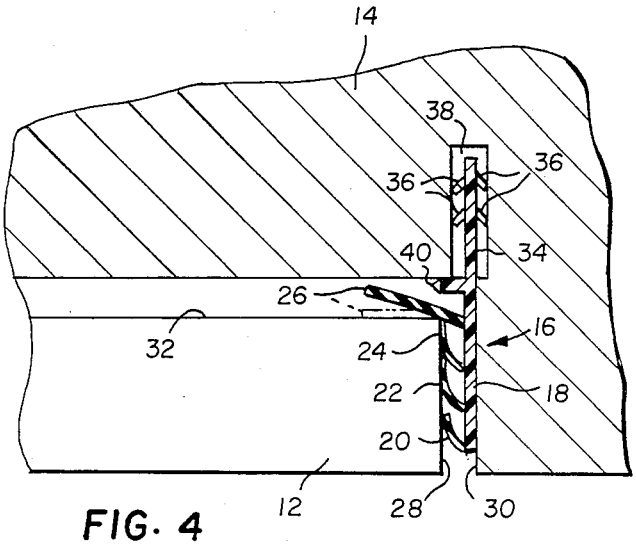
FIG. 4 is an enlarged segmental section view taken substantially along line 4—4 of FIG. 1.
Figure 3:
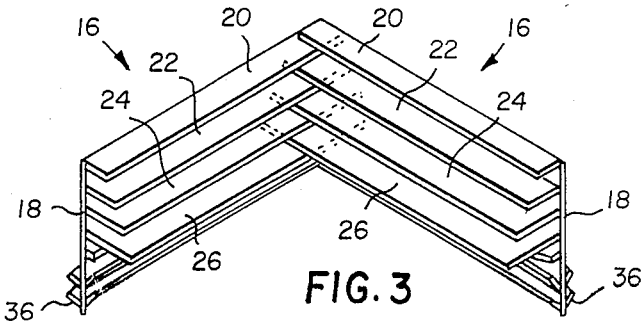
FIG. 3 is a segmental perspective view showing the ends of the weatherseals in interdigitated relation at a corner of the door frame.

Referring now to FIGS. 2 to 4, a weatherseal 16 is shown for sealing the marginal edges of the door, particularly the corners thereof. The weatherseal 16 comprises a longitudinally extending backing strip 18 formed from any suitable plastic material such as polypropylene. A plurality of spaced-apart longitudinally extending flexible barrier fins 20, 22, 24 and 26 are affixed longitudinally along and transversely extending from the front side of backing strip 18. The fins are formed from any suitable elastomeric material, such as SANTOPRENE (a registered trademark of Monsanto), for example. As best seen in FIG. 2, the heights of the fins measured from the front side of backing strip 18 to the free ends of the fins progressively increase from the outermost fin 20 to the innermost fin 26. This arrangement of progressively increasing the fins minimizes the force required to close door 12. As the door is closed, it initially engages the shorter fins 20, 22 which do not present appreciable resistance to the door. The door progressively engages the progressively higher fins 24, 26 which present increased resistance until the door is closed. In this closed position, at least two of the fins engage a face surface 28 of door 12 to seal the space between the door face and the opposing frame face surface 30, as best seen in FIG. 4. In this position, the innermost fin 26 overlies a marginal edge of the exterior surface 32 of the door. The innermost fin assists in sealing the space between door faces 28 and frame faces 30 along at least three sides of the door by sealingly engaging the marginal exterior edge surface of the door, as shown dotted in FIG. 4, when the exterior surface 32 of the door is subjected to wind or the like.

A means for securing weatherseal 16 to a frame member 14 comprises an extension 34 of backing strip 18 having inclined fins 36 affixed thereto, which are insertable into a kerf 38 in frame member 14, as best seen in FIGS. 2 and 4. A stop-lip 40 affixed to backing strip 18 limits the insertion of the backing strip extension 34 into kerf 38. Although this type of attachment means wherein gripping fins engage the opposed surfaces of the kerf is a conventional way to attach a weatherseal to a frame member, any other suitable attachment means, such as an adhesive on the rear side of the backing strip, for example, may be used.

The problem presented by leakage of air, rain, or the like at the corner edges of the door 12 and frame members 14 is effectively solved in this invention by securing the weatherseal strips 16 to the face surfaces 30 of the frame members 14, which are at right angles to one another. The ends of the weatherseals are placed in engagement with the face surfaces 30 with the fins thereof arranged in interdigitated relation, as best seen in FIG. 3. With this arrangement, the entire corner edge surfaces 28 of the door are engaged by one or more fins, thereby effectively preventing any leakage of air, rain or the like through the corner area without the need of a separate corner seal, such as a dust plug, for example.

Figure 5:
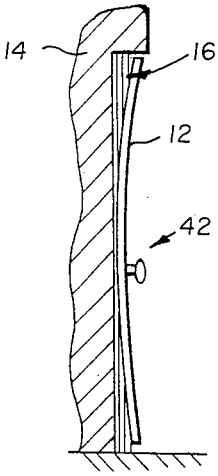
FIG. 5 is a segmental section view in exaggerated form taken substantially along line 5—5 of FIG. 1.

With reference to FIG. 5, a warped door 12 is shown in exaggerated form in which the center of the door is held in a fixed position by a door latch 42 of the conventional type. Such a latch includes a bolt, not shown, which is spring-projected from a door face 28 into a recess or cutout not shown in the adjacent face 30. The warping is particularly prevalent in doors having a wooden interior surface and a metal exterior surface, and the doors are subjected to a temperature differential between the interior and exterior surfaces. With conventional panel and door weatherseal combinations, particularly of the compressible type, the seal is ineffectual at the upper and lower ends of the door, due to the increased spacing between the door and frame stop caused by the warping. However, with the door and frame weatherseal combination of this invention, the face surfaces 28 of the warped door 12 are still engaged by at least one or two of the outermost fins 20, 22 so that leakage between door 12 and frame 14 is still prevented. To achieve this objective, the weatherseal 18 should be provided with at least three sealing fins, but preferably 4 or 5.

While a preferred embodiment of the invention has been shown and described with particularity, it will be appreciated that various changes and modifications may suggest themselves to one having ordinary skill in the art upon being apprised of the present invention. It is intended to encompass all such charges and modifications as fall within the scope and spirit of the appended claims.

What is claimed is:

1. A corner seal assembly for sealing a corner of a panel in a complementary corner of a frame defining an opening, the frame having first and second face surfaces at right angles to one another, comprising:

a first longitudinally extending backing strip of generally uniform cross-section throughout its length, the first backing strip having a plurality of spaced-apart longitudinally extending first barrier fins affixed longitudinally along and transversely extending from the first backing strip;

a second longitudinally extending backing strip of a generally uniform cross-section throughout its length, the second backing strip having a plurality of spaced-apart longitudinally extending second flexible barrier fins affixed longitudinally along and transversely extending from the second backing strip; and means for attaching the first backing strip to the first face surface with one end of the first backing strip abutting the second face surface, and attaching the second backing strip to the second face surface with one end of the second backing strip abutting the first face surface with the first and second barrier fins extending in interdigitated relation.

2. A corner seal assembly according to claim 1 wherein means are provided for securing the weatherseals to the frame.

3. A corner seal assembly according to claim 2 wherein the fins progressively extend further from the backing strip upon progression from the outermost fin to the innermost fin.

4. A corner seal assembly according to claim 3 wherein at least three barrier fins are affixed to the backing strip.

5. A method for installing a weatherseal in a corner of a frame lying in a plane and defining an opening, the frame having first and second face surfaces at right angles to the plane and to one another, comprising the steps of:

attaching to the first face surface a first longitudinally extending backing strip having a plurality of spaced-apart longitudinally extending first flexible barrier fins affixed longitudinally along and transversely extending from the first backing strip with one end of the first backing strip abutting the second face surface;

arranging a second longitudinally extending backing strip having a plurality of spaced-apart longitudinally extending second flexible barrier fins affixed longitudinally along and transversely extending from the second backing strip on the second face surface with one end of the second backing strip abutting the first face surface, and with the first and second barrier fins extending in interdigitated relation; and attaching the second backing strip to the second face surface.

* * * * *